United States Patent [19]

Yasuda

[11] Patent Number: 4,483,165

[45] Date of Patent: Nov. 20, 1984

[54] GAUGE CONTROL METHOD AND APPARATUS FOR MULTI-ROLL ROLLING MILL

[75] Inventor: Kenichi Yasuda, Hitachi, Japan

[73] Assignee: Hitachi, Ltd., Tokyo, Japan

[21] Appl. No.: 467,330

[22] Filed: Feb. 17, 1983

[30] Foreign Application Priority Data

Feb. 19, 1982 [JP] Japan ..... 57-24478

[51] Int. Cl.[3] ..... B21B 37/00

[52] U.S. Cl. ..... 72/8; 72/19; 72/247

[58] Field of Search ..... 72/11, 16, 19, 20, 21, 72/243, 247, 8; 364/472

[56] References Cited

U.S. PATENT DOCUMENTS 3,902,345 9/1975 Shida ..... 72/8

4,320,643 3/1982 Yasuda et al. ..... 72/247

*Primary Examiner*—E. Michael Combs

*Assistant Examiner*—Charles Rosenberg

*Attorney, Agent, or Firm*—Beall Law Offices

[57] ABSTRACT

Gauge control method and apparatus for a multi-roll type upright rolling mill includes displaceable rolls which are movable not only in a first direction in which a material to be rolled is compressed but also in the axial direction thereof or in a direction in which the axis of the displaceable roll is inclined at a variable angle relative to other rolls as viewed in a horizontal plane, the other rolls being movable in the first direction. Position of the displaceable rolls is detected, and in dependence on the displacement of the displaceable roll, coefficient of mill stiffness of the whole rolling mill and those among the individual rolls are arithmetically determined. A roll gap defined between the rolls serving for rolling work is arithmetically determined on the basis of the arithmetically determined coefficients of stiffness, rolling load, and roll bending forces applied to the individual rolls detected by respective detectors. Rolling reduction set by a screw-down device of the rolling mill is controllably regulated in dependence on the roll gap. A high precision gauge control is realized by considering variations in the coefficients of mill stiffness brought about by the roll shifts and changes in the roll bending forces.

19 Claims, 7 Drawing Figures

GAUGE CONTROL METHOD AND APPARATUS FOR MULTI-ROLL ROLLING MILL

The present invention relates to a gauge control method and apparatus for a multi-roll type rolling mill which includes, in addition to the working rolls, a pair of displaceable rolls which are movable not only in the vertical direction but also in the axial direction or in a direction angularly (oblique) to the axis of the working roll at a variable angle within a horizontal plane.

In these years, requirements imposed on rolled products with respect to the accuracy of sheet gauge becomes increasingly severe. Heretofore, a sheet or strip undergoing a rolling work is controlled in respect to the thickness in the longitudinal or lengthwise direction by means of an automatic gauge control (AGC) apparatus, while the thickness in the lateral or widthwise direction (such as shape and crown) is controlled with the aid of a roll bending apparatus, to more or less satisfactory results. However, since the roll bending apparatus is simply so arranged as to apply a bending moment to a roll across both ends thereof, it is impossible to perform the control in such a manner that a complicated shape may be imparted to the product. Under the circumstance, a novel shape control apparatus has been developed and is replacing the roll bending apparatus. According to a characteristic feature of such shape control apparatus, rolls which are movable not only in the direction in which the sheet material is compressed (i.e. in the vertical direction) but also in other directions are made use of in the associated rolling mill. As an example, there can be mentioned a rolling mill which includes axially movable intermediate rolls interposed between work rolls and back-up rolls, respectively. Further, there is known a rolling mill provided with intermediate rolls which are disposed between the work rolls and the back-up rolls, and can be angularly displaced in a horizontal plane with the longitudinal axis of the intermediate roll being inclined at a variable angle relative to the axes of the other rolls. Both of these rolling mills can exhibit far more excellent shape controlling capability than the hitherto known rolling mill by making the most of the displaceability of the intermediate rolls in combination with the actions of the roll bending apparatus.

However, the rolling mill provided with the novel shape control apparatus still suffers a problem remaining to be solved. In other words, the problem lies in the fact that the coefficient of mill stiffness of the rolling mill on the whole undergoes changes upon movement of the displaceable rolls. The coefficient of mill stiffness is closely related to the roll gap which exerts straightforward influence to the sheet-metal gauge of the worked product. As the consequence, changes or variations in the coefficient of mill stiffness occurring in the course of the rolling operation will result in non-uniformity in thickness of the rolled sheet in the longitudinal direction thereof. Further, the automatic gauge control apparatus of BISRA type can not perform the thickness or gauge control with high accuracy unless the mill stiffness can be determined precisely, giving rise to a cause for degrading the longitudinal thickness control accuracy.

To deal with the above problem, there is disclosed an apparatus for compensating for the changes in the coefficient of mill stiffness of the whole rolling mill in Japanese patent publication No. 749/77 which concerns a rolling mill including axially movable or displaceable rolls and in Japanese patent publication No. 26226/77 which concerns a rolling mill including rolls of which inclination angle relative to other rolls, as viewed in a horizontal plane, is variable. However, there arises newly another problem to be solved. More specifically, when a roll bending force $Q_W$ is applied to the work rolls for the purpose of the shape control, the value of the detected rolling load or force is caused to change correspondingly under the influence of the bending force $Q_W$. The problem is seen in the fact that the degree of influence exerted by the bending force does not remain constant but varies as a function of magnitude of displacement or movement of the displaceable roll, that is, the axial displacement thereof or angular displacement in the direction in which the angle of inclination of the center axis of the displaceable roll relative to those of the other rolls is varied as viewed in a horizontal plane. More particularly, a change $\Delta Q_W$ in the bending force $Q_W$ applied to the work roll is in a predetermined proportional relationship to a change $\Delta P_O$ in the rolling force or load $P_O$ detected by a load detector or cell installed on the back-up roll. However, the very constant of proportionality between the changes $\Delta Q_W$ and $\Delta P_O$ undergoes variation in dependence on magnitude of displacement or movement of the displaceable roll, giving rise to the problem mentioned above.

By the way, in connection with a four-roll type rolling mill, there is disclosed in Japanese patent publication No. 32192/72 a method of cancelling the influence of the roll bending force to the rolling load or force. According to this known method, the influence of the work roll bending force $Q_W$ and a back-up roll bending force $Q_B$ to the sheet-metal gauge is compensated for by determining the thickness h of the sheet material at the exit of the rolling mill (also referred to as the exit thickness) in accordance with the following expression:

$$h = S + \frac{P}{K} + \frac{Q_W}{M_W} + \frac{Q_B}{M_B} \tag{1}$$

where S represents the roll gap, P represents a force applied directly to the sheet material, K represents the mill stiffness of the rolling mill on the whole, $M_W$ represents mill stiffness effective between the work rolls, and $M_B$ represents the mill stiffness between the back-up rolls, wherein values determined previously are employed for $M_W$ and $M_B$, respectively. The rolling load or force $P_O$ detected by the load cell is given by $$P_O = P + Q_W + Q_B \tag{2}$$

Accordingly, in consideration of the expression (2), the expression (1) can be rewritten as follows:

$$h = S + \frac{P_O - Q_W - Q_B}{K} + \frac{Q_W}{M_W} + \frac{Q_B}{M_B} \tag{3}$$

$$= S + \frac{P_O}{K} - \left(\frac{1}{K} - \frac{1}{M_W}\right)Q_W - \left(\frac{1}{K} - \frac{1}{M_B}\right)Q_B$$

When changes in h, S, $P_O$, $Q_W$ and $Q_B$ are represented by $\Delta h$, $\Delta S$, $\Delta P_O$, $\Delta Q_W$ and $\Delta Q_B$, the expression (3) is rewritten as follows:

$$\Delta h = \Delta S + \frac{\Delta P_O}{K} - \left(\frac{1}{K} - \frac{1}{M_W}\right) \Delta Q_W - \left(\frac{1}{K} - \frac{1}{M_B}\right) \Delta Q_B \quad (4)$$

When $\Delta h$, $\Delta S$ and $\Delta Q_B$ are assumed to be zero, then $$\Delta P_O = \left(1 - \frac{K}{M_W}\right) \Delta Q_W \quad (5)$$

This expression (5) corresponds to the proportional expression of $\Delta P_O$ and $\Delta Q_W$ described above, wherein the term $(1 - {}_W)$ in the expression (5) is the proportional constant in question. Since both K and $M_W$ are constant in the case of the four-roll type rolling mill, it is impossible to compensate for the change in the relation between $\Delta P_O$ and $\Delta Q_W$ described above. Accordingly, the compensation for the change in the relation between $\Delta P_O$ and $\Delta Q_W$ which is brought about by the displacement of the displaceable rolls, that is, the gauge control based on the accurate determination of the thickness change $\Delta h$ in accordance with the expression (4) can not be accomplished in the case of the hitherto known rolling mill which includes the displaceable rolls.

Further, it should be pointed out that no consideration is paid to changes in the mill stiffness $M_W$ between the work rolls or mill stiffness $M_B$ between the back-up rolls brought about by the movement of the displaceable roll except for the change in the mill stiffness of the rolling mill stand as a whole in the hitherto known rolling mills. As the consequence, change in the thickness or gauge due to the movement of the displaceable roll can not be determined with reasonable accuracy, making it difficult to perform the gauge control with high accuracy.

It is an object of the present invention to provide a gauge control method for a multi-roll type rolling mill which is capable of performing the gauge control with improved accuracy by determining precisely influences of roll bending forces on the rolling force or load while taking into account not only the change in the mill stiffness of the rolling mill stand as a whole but also the changes in the mill stiffness between the individual rolls in pairs as brought about due to movement of the displaceable roll.

Another object of the present invention is to provide a gauge control apparatus for carrying out the method mentioned above.

According to an aspect of the invention, there is provided a gauge control method for a multi-roll type rolling mill including rolls which are displaceable not only in the thickness reducing direction but also in other directions, the method comprising steps of determining the coefficients of mill stiffness of the whole rolling mill stand as well as the inter-roll stiffness in consideration of displacement or movement of the displaceable roll, determining a roll gap between the work rolls on the basis of the coefficients of mill stiffness thus determined, the rolling load and the roll bending forces acting on the rolls, and controlling a screw-down device in conformance with the roll gap thus determined.

According to another aspect of the invention, there is provided a gauge control apparatus for carrying out the method described above.

The above and other objects, novel features and advantages of the present invention will be more apparent when reading the following description of preferred embodiments taken in conjunction with the accompanying drawings, in which.

Figure 1:
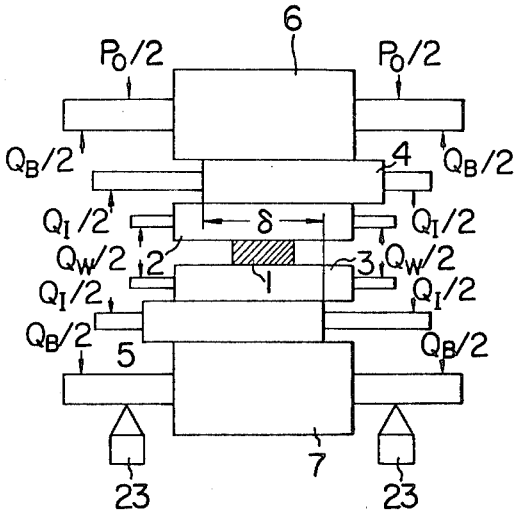
FIG. 1 is a view showing schematically a structure of a six-high rolling mill to which the present invention may be applied.

Now, description will be made in detail on a gauge control apparatus for a multi-roll type rolling mill according to an embodiment of the present invention by referring to the drawings. FIG. 1 shows a structure of a six-high rolling mill in a simplified schematic form. Sheet material 1 to be rolled is caused to pass between an upper work roll 2 and a lower work roll 3 to be thereby rolled down. An upper back-up roll 6 is disposed vertically above the upper work roll 2 with an upper intermediate roll 4 being interposed therebetween, while a lower back-up roll 7 is disposed vertically below the lower work roll 3 with a lower intermediate roll 5 being interposed therebetween. In the case of the illustrated rolling mill, a rolling force or load represented by $P_O$ is applied across the back-up rolls 6 and 7 which are additionally subjected to a bending force $Q_B$. The upper and lower intermediate rolls 4 and 5 are so arranged that they can be moved in the axial directions in opposition to each other. A bending force $Q_I$ is also applied across the intermediate rolls 4 and 5. In FIG. 1, a reference letter $\delta$ represents a distance between one end of the upper intermediate rolls 4 and the end of the lower intermediate roll 5 which is located in opposition to that one end of the upper intermediate roll 4 and provides information about the relative position of the intermediate rolls. When the intermediate rolls 4 and 5 are displaced right- and left-hands, as viewed, respectively, in the axial direction, the distance $\delta$ is correspondingly changed. Further, a bending force $Q_W$ is applied across the upper and the lower work rolls 2 and 3. A roll gap S defined between the upper and the lower work rolls 2 and 3 which serve to roll down the sheet material 1 is adapted to be controlled by a screw-down device generally denoted by 23.

In the rolling mill described above, the thickness h of the rolled sheet or strip 1 at the exit of the mill (also referred to as the exit thickness) is given by the following expression:

$$h + S + \frac{P}{K} + \frac{Q_W}{M_W} + \frac{Q_I}{M_I} + \frac{Q_B}{M_B} \quad (6)$$

where

S: roll gap between the work rolls,

P: force applied directly to the sheet material,

K: coefficient of mill stiffness of the rolling mill on the whole, $Q_W$: bending force acting on the work rolls, $Q_I$: bending force acting on the intermediate rolls, $Q_B$: bending force acting on the back-up rolls, $M_W$: coefficient of mill stiffness effective between the work rolls, $M_I$: coefficient of mill stiffness effective between the intermediate rolls, and $M_B$: coefficient of mill stiffness effective between the back-up rolls.

When the load $P_O$ detected by the load cell and given by $P_O=P+Q_W+Q_B+Q_I$ is taken into account, the above expression (6) can be rewritten as follows:

$$h = S + \frac{P_O}{K} - \left(\frac{1}{K} - \frac{1}{M_W}\right) Q_W - \left(\frac{1}{K} - \frac{1}{M_B}\right) Q_B - \left(\frac{1}{K} - \frac{1}{M_I}\right) Q_I \quad (7)$$

When variations of the variables h, S, $P_O$, $Q_W$, $Q_B$ and $Q_I$ are represented by $\Delta h$, $\Delta S$, $\Delta P_O$, $\Delta Q_W$, $\Delta Q_B$ and $\Delta Q_I$, respectively, the expression (7) can be changed as follows:

$$\Delta h = \Delta S + \frac{\Delta P_O}{K} - \left(\frac{1}{K} - \frac{1}{M_W}\right) \Delta Q_W - \left(\frac{1}{K} - \frac{1}{M_B}\right) \Delta Q_B - \left(\frac{1}{K} - \frac{1}{M_I}\right) \Delta Q_I \quad (8)$$

Assuming that the variations $\Delta h$, $\Delta S$, $\Delta Q_B$, and $\Delta Q_I$ are zero, following relation applies valid.

$$\Delta P_O = \left(1 - \frac{K}{M_W}\right) \Delta Q_W \quad (9)$$

Figure 2:
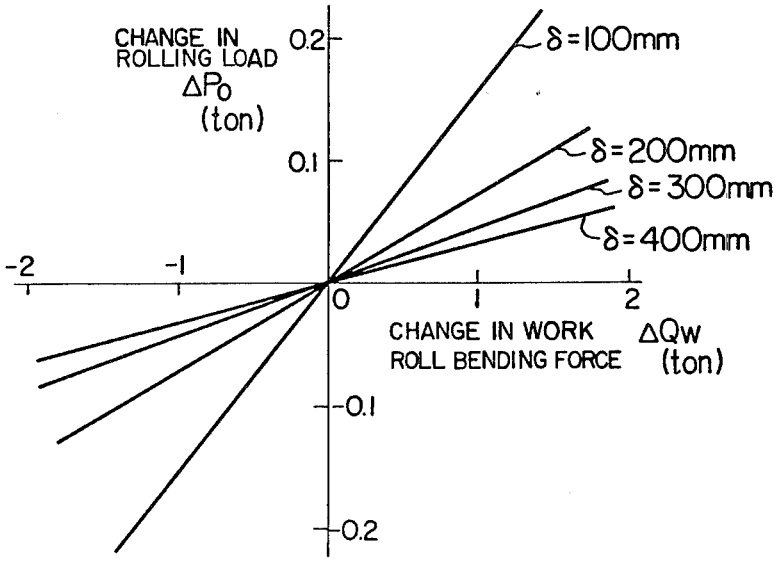
FIG. 2 is a view illustrating graphically relationships between changes in work roll bending force and changes in rolling load detected through a load cell.

It will be seen that the above expression (9) is in the same form as the expression (5) mentioned hereinbefore. Through the similar procedures, it is possible to derive $\Delta P_O$ for $\Delta Q_I$ and $\Delta Q_B$, respectively. The relation given by the above expression (9) is graphically represented in FIG. 2. More specifically, there are illustrated in FIG. 2 values of $\Delta P_O$ as a function of $\Delta Q_W$ on the assumption that the distance $\delta$ between the intermediate rolls 4 and 5 as defined hereinbefore takes values of 100 mm, 200 mm, 300 mm and 400 mm. In this connection, the units of $\Delta Q_W$ and $\Delta P_O$ are given in metric tons.

With the present invention, it is contemplated to accomplish the gauge control for the rolling mill with an improved accuracy by compensating the variation or change in the rolling load brought about due to variations or changes in the bending forces acting on the individual rolls in dependence on the displacements of the intermediate rolls.

Figure 3:
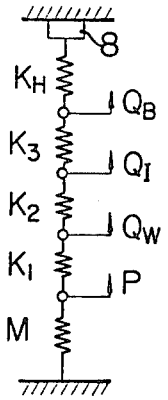
FIG. 3 is a view illustrating the rolling mill shown in FIG. 3 in a form of a spring model.

For the convenience of elucidation, let's represent the six-high rolling mill shown in FIG. 1 in a form of a spring model illustrated in FIG. 3. Apparently, the following relations apply validly:

$$\frac{1}{K} = \frac{1}{K_1} + \frac{1}{K_2} + \frac{1}{K_3} + \frac{1}{K_H} \quad (10)$$

$$\frac{1}{M_W} = \frac{1}{K_2} + \frac{1}{K_3} + \frac{1}{K_H} \quad (11)$$

$$\frac{1}{M_I} = \frac{1}{K_3} + \frac{1}{K_H} \quad (12)$$

$$\frac{1}{M_B} = \frac{1}{K_H} \quad (13)$$

where $K_1$ represents a spring constant existing between the surfaces of the upper and the lower work rolls (2; 3) and the centers thereof, respectively, $K_2$ represents a spring constant between the centers of the upper and the lower work rolls (2; 3) and the upper and the lower intermediate rolls (4; 5), respectively, $K_3$ represents a spring constant between the centers of the upper and the lower intermediate rolls (4; 5) and the upper and the lower back-up rolls (6; 7), respectively, and $K_H$ represents a spring constant of a housing which accommodates the various rolls mentioned above. Further, a symbol M shown in FIG. 3 represents a spring constant (or coefficient of plasticity) of the sheet material itself. It will be understood from the description made hereinbefore with reference to FIG. 1 that only the spring constants $K_2$ and $K_3$ undergo variation when the position $\delta$ of the axially movable upper and lower intermediate rolls 4 and 5 is changed. In other words, when the position or distance $\delta$ between these upper and lower intermediate rolls is changed, the contacting state among the intermediate rolls 4; 5, the work rolls 2; 3 and the back-up rolls 6; 7 is correspondingly changed, resulting in that deformations of these rolls due to the mutual contact are subjected to variations, to thereby give rise to the changes in the spring constant $K_2$ and $K_3$. As is apparent from the expressions (10), (11) and (12), only the coefficients of mill stiffness K, $M_W$ and $M_I$ are variable in dependence on the change in the axial position or distance $\delta$ between the intermediate rolls 4 and 5, while the coefficient of mill stiffness $M_B$ remains invariable. Accordingly, it is only necessary to determine previously the relationships between the position or distance $\delta$ of the intermediate rolls (4; 5) and the coefficients of mill stiffness K, $M_W$ and $M_I$. In this connection, it should be mentioned that the coefficient K, i.e. the coefficient of mill stiffness of the whole rolling mill is preliminarily known, and that the coefficients $M_W$ and $M_I$ can be experimentally determined. For example, the coefficient $M_W$ may be determined by measuring the bending force and the inter-axis distance between the work rolls 2 and 3 at different positions $\delta$ of the intermediate rolls 4 and 5. Determination of the coefficient $M_I$ may be made in the similar manner. Relationships between the position or inter-end distance $\delta$ of the intermediate rolls (4; 5) and the coefficient of mill stiffness K, $M_I$ and $M_W$ as determined in this way are graphically illustrated in FIG. 4, by way of example. In connection with the graphical illustration of FIG. 4, it is to be noted that the curves are depicted on the basis of data obtained from the experimental measurements made for a rolling mill realized in accordance with the model shown in FIG. 1 on the conditions that the work rolls are 100 mm in diameter and the bending force $Q_W$ applied therebetween is 2 tons; the intermediate rolls 4 and 5 are 130 mm in diameter and the applied bending force $Q_I$ is 4 tons; the back-up rolls 6 and 7 are 300 mm in diameter and the applied bending force $Q_B$ is 8 tons; the rolling load is 100 tons at maximum; the sheet material to be worked is 200 mm in width; and that the axial length of each roll is 400 mm, which means that the distance δ of 400 mm indicates that the mutual displacement of the intermediate rolls is zero.

Figure 5:
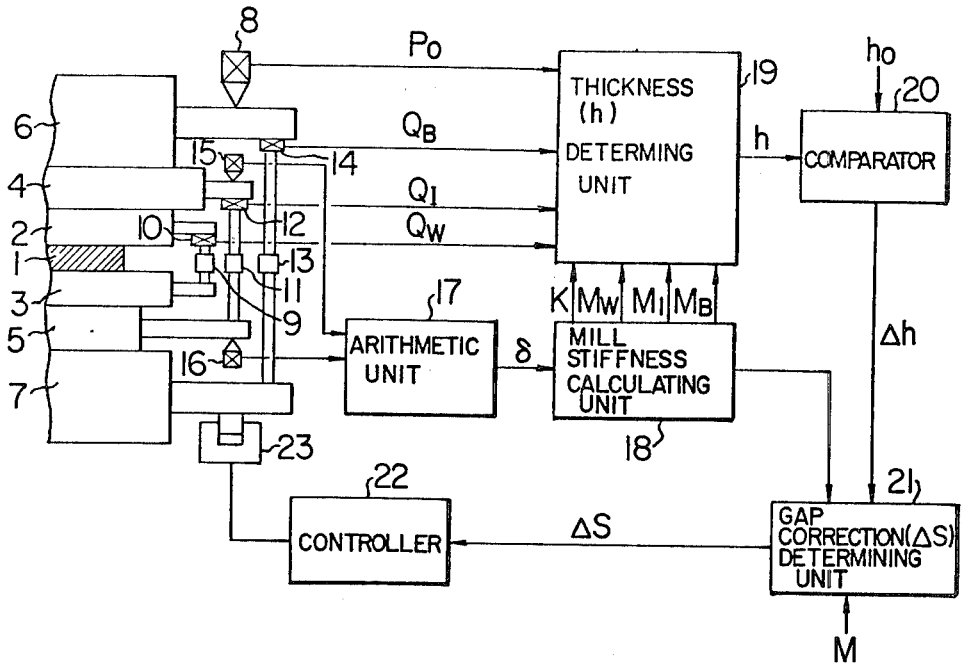
FIG. 5 is a view showing an arrangement of a gauge control apparatus for a rolling mill implemented in a feedback control mode according to an embodiment of the present invention.

In the foregoing, the principle of the invention has been elucidated. Now, the invention will be described in more detail in conjunction with an exemplary embodiment. Referring to FIG. 5 which shows a gauge control apparatus for the rolling mill according to an embodiment of the invention, the thickness of a sheet material 1 is rolled down by the work rolls 2 and 3. Intermediate rolls 4 and 5 which are movable in the axial directions are interposed between the work rolls 2 and 3 and the back-up rolls 6 and 7, respectively. The overall rolling load $P_O$ is detected by means of a load cell 8, while the bending force $Q_W$ applied to the work rolls 2 and 3 by a bending device 9 is detected through another load cell 10 or alternatively through a hydraulic pressure detecting device provided in association with the bending device 9. On the other hand, the bending force $Q_I$ applied to the intermediate rolls 4 and 5 by a bending device 11 is detected by a load cell 12 or alternatively through a hydraulic pressure detecting device provided in association with the bending device 11. In a similar manner, the bending force $Q_B$ applied to the back-up rolls 6 and 7 by a bending device 13 is detected through a load cell 14 or a hydraulic pressure detector provided for the bending device 13.

Further, the positions of the intermediate rolls 4 and 5 are determined by an arithmetic operation unit 17 on the basis of detection signals outputted from position detectors 15 and 16, respectively. The arithmetic operation unit 17 produces at the output a position or distance signal δ which is supplied to a mill stiffness determining operation unit 18 which operates to arithmetically determine the coefficients of mill stiffness K, $M_W$, $M_I$ and $M_B$, respectively, on the basis of the inter-end distance δ between the intermediate rolls 4 and 5 in accordance with the relations illustrated in FIG. 4. More specifically, since all the coefficients K, $M_W$, $M_I$ and $M_B$ are functions of the inter-end distance δ mentioned above and represented by $K=f_K(\delta)$, $M_W=f_W(\delta)$, $M_I=f_I(\delta)$ and $M_B=f_B(\delta)$, respectively, the arithmetic determination of these coefficients can be readily realized by the arithmetic operation unit 18 in a known manner. The coefficients of mill stiffness thus arithmetically determined are supplied to an arithmetic operation unit 19 which is adapted to arithmetically determine the exit thickness h of the rolled sheet material in accordance with the aforementioned expression (6) on the basis of the bending force signals $P_O$, $Q_W$, $Q_I$ and $Q_B$ supplied from the respective load cells 8, 10, 12 and 14 and the coefficients of mill stiffness K, $M_W$, $M_I$ and $M_B$ supplied from the arithmetic operation circuit 18. By the way, the symbol P in the expression (6) represents the rolling force applied directly to the sheet material and differs from the measured rolling load $P_O$. However, the former can be derived from the latter in accordance with the following equation:

$$P=P_O-(Q_W+Q_I+Q_B) \tag{14}$$

The thickness h thus determined is compared with a desired thickness $h_O$ through a comparator 20, the output signal of which represents difference or deviation Δh of the thickness h from the desired one $h_O$ and is applied to an arithmetic circuit 21. This arithmetic circuit 21 is adapted to arithmetically determine a correcting quantity ΔS of the roll gap S for compensating for the thickness deviation Δh in accordance with the following expression:

$$\Delta S = \frac{M+K}{K} \cdot \Delta h \tag{15}$$

where M represents the coefficient of plasticity of the sheet material to be rolled which is known. The gap correction signal ΔS is applied to a controller 22 for a screw-down device 23 for correctively regulating the roll gap S. In this manner, the thickness h of the sheet material at the exit of the rolling mill is so controlled as to be equal to the desired value $h_O$.

As will be appreciated from the foregoing description, it can be accomplished according to the present invention that the coefficient of mill stiffness of the rolling mill on the whole as well as those of the individual rolls which undergo variations upon axial movement of the intermediate rolls are determined accurately and that influences exerted to the rolling load or force by the bending forces applied to the individual rolls are accurately determined and properly taken into consideration in determining the roll gap for controlling the thickness of the rolled sheet material, whereby the gauge control for the multi-stage rolling mill can be realized with an extremely high precision. More particularly, taking as a numerical example a six-stage rolling mill to which the relationships illustrated in FIG. 4 apply, the coefficients of mill stiffness K, $M_W$ and $M_I$ are 35 tons/mm, 37 tons/mm and 39.2 tons/mm, respectively, when the relative displacement of the intermediate rolls 4 and 5 is 200 mm, i.e. δ=200 mm. Since the bending force $Q_B$ applied to the back-up rolls is set equal to zero, the coefficient of mill stiffness $M_B$ is neglected in this consideration. On the rolling conditions that H (thickness at the entrance)=0.5 mm, h=0.36 mm, b=200 mm, P=54 tons, $Q_W$=2 tons and that $Q_I$=4 tons which are typical in the rolling mill of the six-stage structure illustrated in FIG. 1, the roll gap S can be determined in accordance with the expression (6) as follows:

$$\text{Since } h = S + \frac{P}{K} + \frac{Q_W}{M_W} + \frac{Q_I}{M_B} + \frac{Q_B}{M_B},$$

$$0.36 = S + \frac{54}{35} + \frac{2}{37} + \frac{4}{39.2} + \frac{0}{0}$$

$$= S + 1.543 + 0.054 + 0.102$$

$$\text{Hence, } S = -1.339$$

Figure 4:
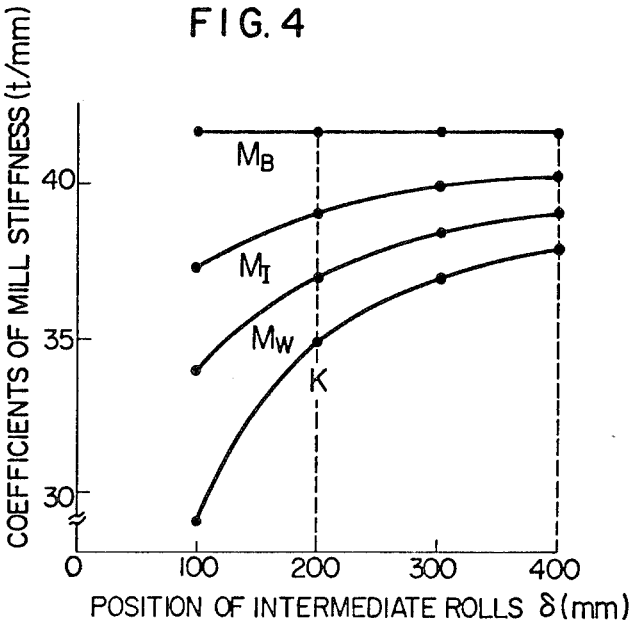
FIG. 4 is a view illustrating graphically change in coefficients of mill stiffness as a function of position of displaceable rolls.

On the other hand, when values 38 tons/mm, 38.8 tons/mm and 40.2 tons/mm of the coefficients of mill stiffness K, $M_W$ and $M_I$, respectively, which can be derived from the relationships illustrated in FIG. 4 on the assumption that displacement of the intermediate rolls 4 and 5 is not taken into account, i.e. δ=400 mm as is in the case of the hitherto known rolling mill control, are placed in the expression (6), as they are, for the same roll gap S (i.e. −1.339), then $$h = -1.339 + \frac{54}{38} + \frac{2}{38.8} + \frac{4}{40.2}$$

-continued $$= 0.345$$

It will now be clearly understood that the roll gap has heretofore been controlled with the aid of the control quantity accompanied with error which amounts to as large as about 4.1% of the exit thickness h. In contrast, it is possible according to the invention to accomplish the gauge control in the rolling mill with highly improved accuracy by virtue of the inventive feature that the roll gap is controlled precisely by considering variations or changes in the coefficients of mill stiffness of the rolling mill and the individual rolls thereof which are brought about by the displacement of the intermediate rolls.

In the following, other embodiments of the invention will be described.

Figure 6:
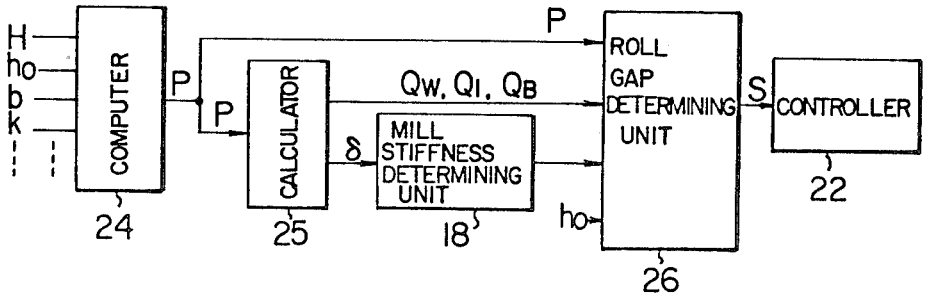
FIG. 6 is a view showing an arrangement of the gauge control apparatus for a rolling mill according to another embodiment of the present invention.

The gauge control apparatus described above is implemented based on a feedback control system. Same concept may be applied to an open-loop control system for the rolling mill, an example of which is shown in FIG. 6. Referring to the figure, a computer 24 receives as inputs thereto the various known rolling parameters such as the entrance thickness H of the sheet material to be rolled, the desired reduced thickness $h_O$, width b and deformation resistance k and arithmetically determines the rolling load P in accordance with the following expression which per se is known:

$$P = k \cdot Q_p \cdot b \cdot \sqrt{R'(H - h_O)} \quad (16)$$

where $Q_P$ represents a correction factor known in the art and R' represents the radius of the work roll during rolling work. Subsequently, a calculator 25 arithmetically determines the position δ of the intermediate roll and the bending forces $Q_W$, $Q_I$ and $Q_B$ on the basis of the rolling load P thus obtained and the rolling parameters in a manner also known in itself. When the position of the intermediate rolls is determined, the corresponding value is supplied to the arithmetic unit 18 which may be the same as the one shown in FIG. 5 for determining the coefficients of mill stiffness in concern. From the input quantities shown in FIG. 6, an arithmetic operation unit 26 determines the roll gap S for allowing the desired exit thickness $h_O$ of the workpiece to be attained in accordance with the following expression which is a modification of the expression (6). Namely, $$S = h_O - \frac{P}{K} - \frac{Q_W}{M_W} - \frac{Q_I}{M_I} - \frac{Q_B}{M_B} \quad (17)$$

The quantity S thus obtained is supplied to the controller 22 for the screw-down device 23, whereupon the rolling operation can be started.

Figure 7:
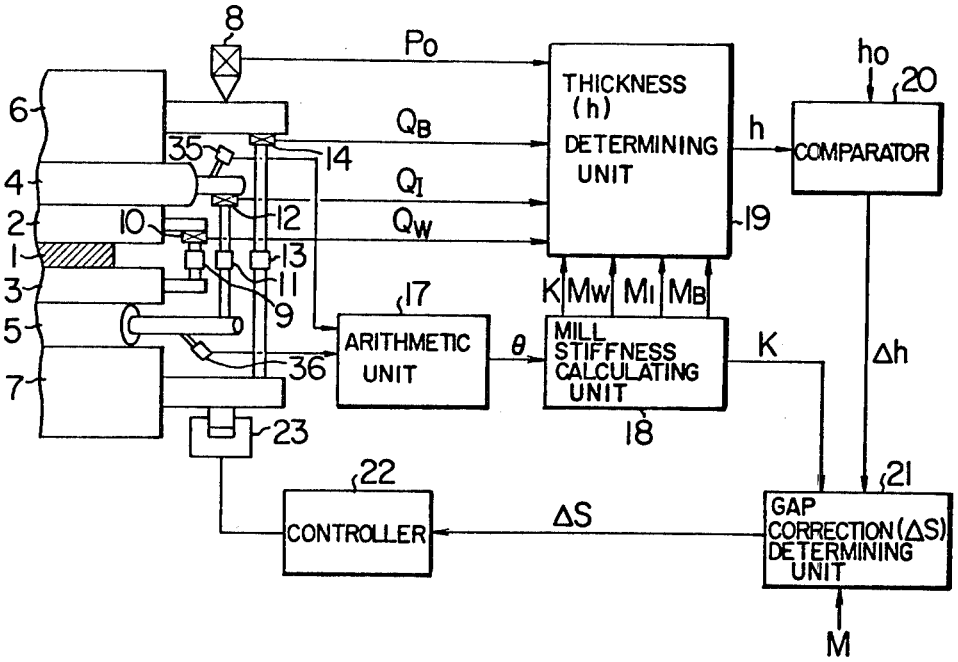
FIG. 7 is a view showing an arrangement of the gauge control apparatus for a six-high rolling mill according to a further embodiment of the present invention.

In the foregoing, the present invention has been described in conjunction with six-high rolling mills in which the intermediate rolls are displaced and the work rolls are subjected to bending force. However, it will be readily appreciated that the concept of the invention may equally be applied to other rolling mills such as skew roll mills or the like which incorporate the rolls movable in given directions. For example, in the case of a skew roll mill shown in FIG. 7, an angle of inclination of the intermediate roll (4; 5) relative to the axes of other rolls in a horizontal plane may be employed in place of the axial displacement δ of the intermediate rolls, which angle may be detected by using suitable inclination angle detectors 35; 36. The angle ⊖ thus detected may be made use of for controlling the roll gap S in the utterly same manner as described hereinbefore. Further, in the case of the rolling mill shown in FIG. 5, the bending force is applied to all of the rolls. It goes, however, without saying that the present invention can also be applied to the rolling mills of other arrangements in which the bending force is applied to only the work rolls or to both the work rolls and the intermediate rolls. In these cases, the basic concept of the invention also can be equally applied except that the term $Q_I$ and/or $Q_B$ of the expressions (6) and (17) is neglected. Obviously, other modifications and variations will readily occur to those skilled in the art without departing the spirit and scope of the invention.

I claim:

1. A gauge control method for a rolling mill of multi-roll type including working rolls and displaceable rolls which can be moved in a first direction in which the working rolls are moved for rolling material and in a second direction different from said first direction, said method comprising the steps of:

determining a coefficient of mill stiffness for the entirety of said rolling mill and coefficients of mill stiffness occurring among the individual rolls in dependence on displacement of said displaceable rolls;

determining on the basis of said coefficients of mill stiffness for the entirety of said rolling mill and occurring among the individual rolls, a rolling load and roll bending forces imparted to the working and displaceable rolls, a roll gap adjustment signal; and controlling a screw-down device for said rolling mill in accordance with the determined value of said roll gap adjustment signal.

2. A gauge control method for a rolling mill of multi-roll type according to claim 1, wherein said second direction of said displaceable rolls coincides with the axial direction of said displaceable rolls.

3. A gauge control method for a rolling mill of multi-roll type according to claim 1, wherein the axes of the rolls other than the displaceable rolls define a horizontal plane and said second direction of each of said displaceable rolls lies in a direction in which the axis of said displaceable roll is inclined at a variable angle relative to said horizontal plane.

4. A gauge control method for a rolling mill of multi-roll type according to claim 1, comprising steps of:

determining arithmetically an estimated magnitude of said rolling load on the basis of rolling conditions;

determining arithmetically the displacement of said displaceable rolls on the basis of said rolling conditions and said estimated rolling load; and determining subsequently the coefficient of mill stiffness on the entirety of said rolling mill and the coefficients of mill stiffness occurring among the rolls in dependence on said displacement of said displaceable rolls.

5. A gauge control method for a rolling mill of multi-roll type according to claim 1, wherein said multi-roll rolling mill includes back-up rolls and wherein said displaceable rolls are interposed between said working rolls and said back-up rolls.

6. A gauge control method for a rolling mill of multi-roll type according to claim 5, wherein said roll bending force is applied to individual ones of said working rolls, said back-up rolls and said displaceable rolls.

7. A gauge control apparatus for a rolling mill of multi-roll type including displaceable rolls which can be moved in a first direction in which material to be rolled is compressed and in a second direction different from said first direction, and other rolls movable in said first direction, comprising:

first arithmetic means for arithmetically determining a coefficient of mill stiffness of the entirety of said rolling mill, and coefficients of stiffness of the individual ones of said displaceable and other rolls in consideration of the position of said displaceable rolls;

second arithmetic means for arithmetically determining on the basis of said arithmetically determined coefficients of stiffness, and a rolling load and roll bending forces applied to the displaceable and other rolls, a roll gap defined between the ones of said rolls in rolling contact with said material; and means for controlling rolling reduction for said rolling mill in dependence on said arithmetically determined roll gap.

8. A gauge control apparatus for a rolling mill of multi-roll type according to claim 7, wherein said rolling mill is provided with load detecting means for detecting the rolling load, position detecting means for detecting the position of said displaceable rolls, and bending force detecting means for detecting bending forces applied to the rolls, respectively.

9. A gauge control apparatus for a rolling mill of multi-roll type according to claim 7, further comprising load setting means for setting the rolling load, position setting means for setting the positions of said displaceable rolls, and bending force setting means for setting the bending forces applied to said rolls, respectively.

10. The gauge control apparatus of claim 7, wherein said apparatus further comprises:

means for estimating said rolling load on the basis of rolling conditions; and means for determining said movement of said displacement rolls and for determining said roll bending forces on the basis of said estimated rolling load.

11. The gauge control apparatus of claim 7, wherein said first arithmetic means determines said coefficient of mill stiffness and said coefficients of stiffness of the individual ones of said displaceable and other rolls on the basis of the axial displacement of said displaceable rolls.

12. The gauge control apparatus of claim 7, wherein said first arithmetic means determines said coefficient of mill stiffness and said coefficients of stiffness of the individual ones of said displaceable and other rolls on the basis of the angle of inclination of the axes of said displaceable rolls relative to a horizontal plane defined by the axes of the other rolls.

13. A gauge control apparatus for a rolling mill of multi-roll type including displaceable rolls which can be moved in a first direction in which material to be rolled is compressed and in a second direction different from said first direction, and other rolls moveable in said first direction, comprising:

first means for arithmetically determining on the basis of movement of said displaceable rolls, a coefficient of mill stiffness for the entire rolling mill and coefficients of stiffness between pairs of said rolls;

means for providing indications of a rolling load applied to the rolls and roll bending forces acting on said pairs of rolls;

means for determining a roll gap correction signal on the basis of said coefficient of mill stiffness, said coefficients of stiffness between pairs of said rolls, said rolling load, and said roll bending forces; and means for adjusting rolling reduction of said rolling mill in response to said roll gap correction signal.

14. The gauge control apparatus of claim 13, wherein said means for providing said indications further comprises:

means for estimating said rolling load on the basis of rolling conditions; and means for determining said movement of said displaceable rolls and for generating said indications of said roll bending forces on the basis of said estimated rolling load.

15. The gauge control apparatus of claim 13, wherein said first arithmetic means determines said coefficient of mill stiffness and said coefficients of stiffness of said pairs of rolls on the basis of the relative axial displacement of said displaceable rolls.

16. The gauge control apparatus of claim 13, wherein said first arithmetic means determines said coefficient of mill stiffness and said coefficients of stiffness of said pairs of rolls on the basis of the angle of inclination between the axes of the displaceable rolls relative to a horizontal plane defined by the axes of the other rolls.

17. The gauge control apparatus of claim 13, wherein said means for determining said roll gap adjustment signal comprises:

means for determining the exit thickness of said material on the basis of said coefficient of mill stiffness, said coefficients of stiffness between pairs of said rolls, said rolling load, and said roll bending forces;

means for comparing said exit thickness with a value representing the desired thickness of said material and for providing an output signal representing deviations between the values of said exit thickness and said desired thickness; and second means for arithmetically determining said roll gap correction signal in response to said output signal.

18. The gauge control apparatus of claim 13, wherein said means for determining said roll gap correction signal is operatively responsive to reception of an input signal representing a coefficient of a characteristic of said material.

19. The gauge control apparatus of claim 17, wherein said second arithmetic means generates said roll gap correction signal in response to reception of said output signal and an input signal representative of a coefficient of a characteristic of said material.

* * * * *